US010093477B2

(12) United States Patent
Di Bona

(10) Patent No.: US 10,093,477 B2
(45) Date of Patent: Oct. 9, 2018

(54) DECORATIVE SHAPED HARDWARE TRAY

(71) Applicant: Paul Di Bona, Bronxville, NY (US)

(72) Inventor: Paul Di Bona, Bronxville, NY (US)

( * ) Notice: Subject to any disclaimer, the term of this patent is extended or adjusted under 35 U.S.C. 154(b) by 0 days.

(21) Appl. No.: 15/477,789

(22) Filed: Apr. 3, 2017

(65) Prior Publication Data

US 2017/0297810 A1 Oct. 19, 2017

Related U.S. Application Data

(60) Provisional application No. 62/316,994, filed on Apr. 1, 2016.

(51) Int. Cl.

| | |
|---|---|
| ***B65D 85/68*** | (2006.01) |
| ***B65D 25/04*** | (2006.01) |
| ***B65D 25/14*** | (2006.01) |
| ***B65D 43/16*** | (2006.01) |
| ***B25H 3/00*** | (2006.01) |
| ***B65D 81/36*** | (2006.01) |

(52) U.S. Cl.

CPC ..... *B65D 85/68* (2013.01); *B25H 3/00* (2013.01); *B65D 25/04* (2013.01); *B65D 25/14* (2013.01); *B65D 43/163* (2013.01); *B65D 81/365* (2013.01); *B65D 2585/6887* (2013.01)

(58) Field of Classification Search

CPC ..... B65D 85/68; B65D 43/162; B65D 2585/6887; B65D 81/365; B25H 3/00

USPC ..... 206/457, 373, 372

See application file for complete search history.

(56) References Cited

U.S. PATENT DOCUMENTS

| | | | | | |
|---|---|---|---|---|---|
| 4,030,235 | A | * | 6/1977 | Terzian | A63H 3/52 446/296 |
| 4,753,346 | A | * | 6/1988 | Tsuji | A45C 11/36 206/224 |
| 4,850,092 | A | * | 7/1989 | Newarski | B25H 3/06 206/373 |
| D324,306 | S | * | 3/1992 | Lin | D3/271.12 |
| 5,213,504 | A | * | 5/1993 | Lee | G09B 11/06 106/31.61 |
| 5,226,540 | A | * | 7/1993 | Bradbury | G06F 1/1628 206/320 |
| 5,441,149 | A | * | 8/1995 | Willard | A45C 11/34 206/214 |
| D379,481 | S | * | 5/1997 | Johnson | 280/37 |
| 5,951,358 | A | * | 9/1999 | Hilko | A63H 33/38 206/424 |
| 6,026,960 | A | * | 2/2000 | Cogliano | A63H 3/005 206/457 |
| 6,065,595 | A | * | 5/2000 | Ratcliff | A01K 97/06 206/315.11 |
| D432,302 | S | * | 10/2000 | Chen | D21/551 |
| D447,339 | S | * | 9/2001 | Rosmon | D3/271.12 |

(Continued)

*Primary Examiner* — Steven A. Reynolds

(74) *Attorney, Agent, or Firm* — Leason Ellis LLP

(57) ABSTRACT

A decorative shaped hardware tray in the form of a vehicle is provided and is designed to easily organize various hardware parts removed from a vehicle being worked on. The car-shaped hardware tray includes a base and a cover and the base includes a plurality of compartments for storing hardware. The location of each compartment within the tray matches the location of an actual vehicle from which the hardware is taken. In this way, when a user removes hardware from a vehicle being repaired, the user places the hardware in the compartment that corresponds to the part being repaired on the vehicle.

12 Claims, 3 Drawing Sheets

(56) References Cited

U.S. PATENT DOCUMENTS

| | | | | |
|---|---|---|---|---|
| 6,390,298 | B1 * | 5/2002 | Garro | B25H 3/003 206/378 |
| 6,568,532 | B1 * | 5/2003 | Leach | B65D 5/4233 206/457 |
| 7,681,412 | B1 * | 3/2010 | Arroyo | B65D 81/365 206/457 |
| D624,313 | S * | 9/2010 | Mitchell | D3/271.12 |
| D651,798 | S * | 1/2012 | Colchiesqui | D3/271.12 |
| 2003/0168371 | A1 * | 9/2003 | Weimer | A45C 11/20 206/457 |
| 2012/0118765 | A1 * | 5/2012 | Hippely | A63H 18/00 206/216 |
| 2013/0127129 | A1 * | 5/2013 | Bensman | B62B 5/00 280/47.26 |

* cited by examiner

DECORATIVE SHAPED HARDWARE TRAY

CROSS-REFERENCE TO RELATED APPLICATION

The present application claims priority to U.S. patent application Ser. No. 62/316,994, filed Apr. 1, 2016, which is hereby incorporated by reference in its entirety.

TECHNICAL FIELD

The present invention is directed to a hardware tray and more particularly, is directed to a decorative shaped hardware tray in the form of a vehicle that easily organizes various hardware parts.

BACKGROUND

Organization units are used in a many settings for organizing many different types of objects. In a garage or similar setting, organization units also come in many different forms and are used to organize and store tools, automobile parts, fasteners, etc.

An automobile repair shop (also known as a garage) is a repair shop where automobiles are repaired by auto mechanics. Automotive repair shops also offer paintwork repairs to scratches, scuffs, and dents to vehicle damage as well as damage caused by collisions and major accidents. Often times when repairing a vehicle, it is required that a number of damaged vehicle body parts be removed from the vehicle. Each body part has its own associated hardware. It will therefore be appreciated that it is very easy for parts from different body parts to become comingled. This at the very least complicates the job of reattaching the various body parts and sometimes, if a part is misplaced, it may not be used during the reassembly process.

While generic organization units are available, these generic units only include a plurality of compartments into which hardware can be placed. The hardware can be in the form of nuts, bolts, clips and other small parts. While these generic units have compartments that receive hardware, they do not reduce the risk of comingling parts since when working with the removal of many parts, it is difficult to remember which compartments correspond to which part.

The present invention overcomes the deficiencies associated with traditional organization units.

SUMMARY

The present invention is directed to a hardware tray and more particularly, is directed to a decorative shaped hardware tray in the form of a vehicle that easily organizes various hardware parts. The car-shaped hardware tray includes a base and a cover and the base includes a plurality of compartments for storing hardware. The location of each compartment within the tray matches the location of an actual vehicle from which the hardware is taken. In this way, when a user removes hardware from a vehicle being repaired, the user places the hardware in the compartment that corresponds to the part being repaired on the vehicle. For example, if the front bumper is removed in order to repair the front bumper or reach another part behind the front bumper, etc., the hardware that is removed from the front bumper, e.g., nuts, clips, bolts, and other small parts, etc., is placed in compartment which corresponds to the front bumper compartment. In this way, the hardware taken off of the front bumper is carefully segregated from the other hardware associated with the other parts and thus, cannot be accidentally comingled or misplaced. By shaping the tray in a vehicle shape, the user immediately knows where to place and where to retrieve hardware when working on any vehicle.

BRIEF DESCRIPTION OF THE DRAWING FIGURES

DETAILED DESCRIPTION OF CERTAIN EMBODIMENTS

Figure 1:
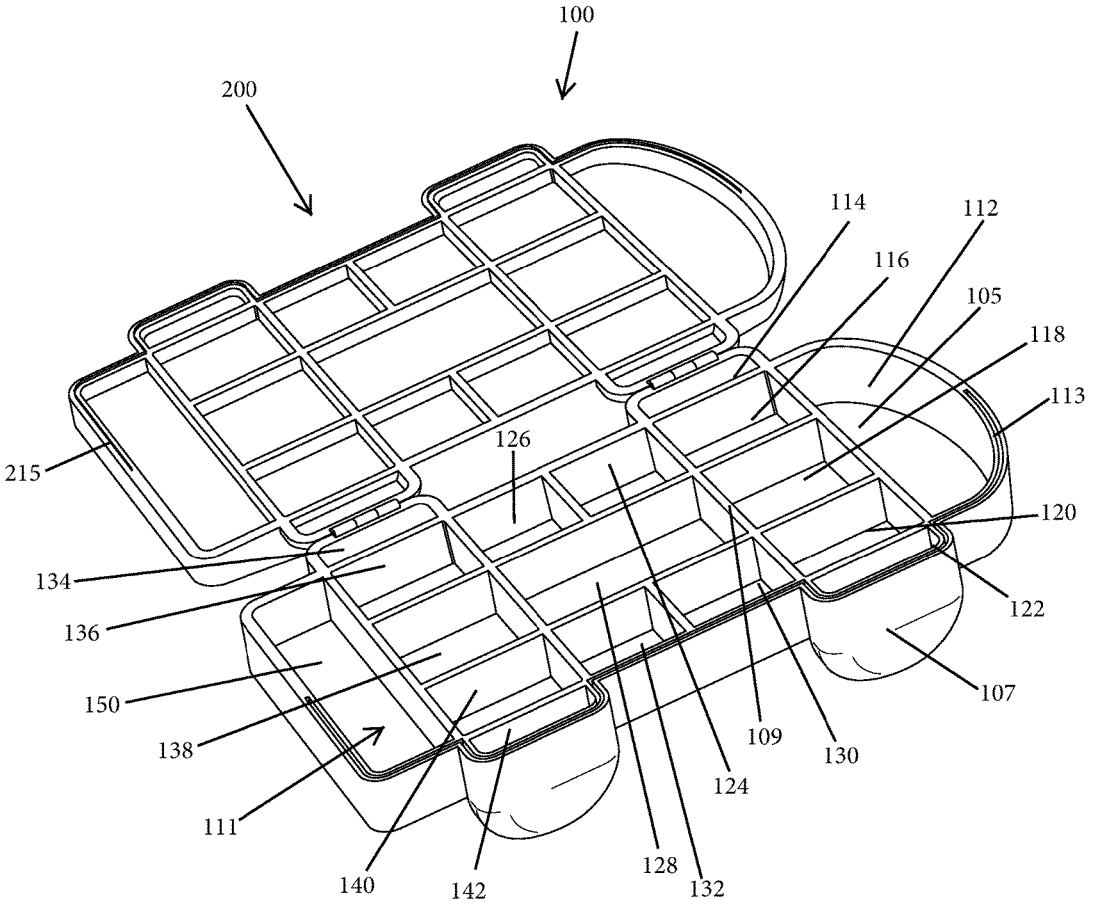
FIG. 1 is a perspective view of a car-shaped hardware tray in an open position and in accordance with one embodiment of the present invention.
Figure 2:
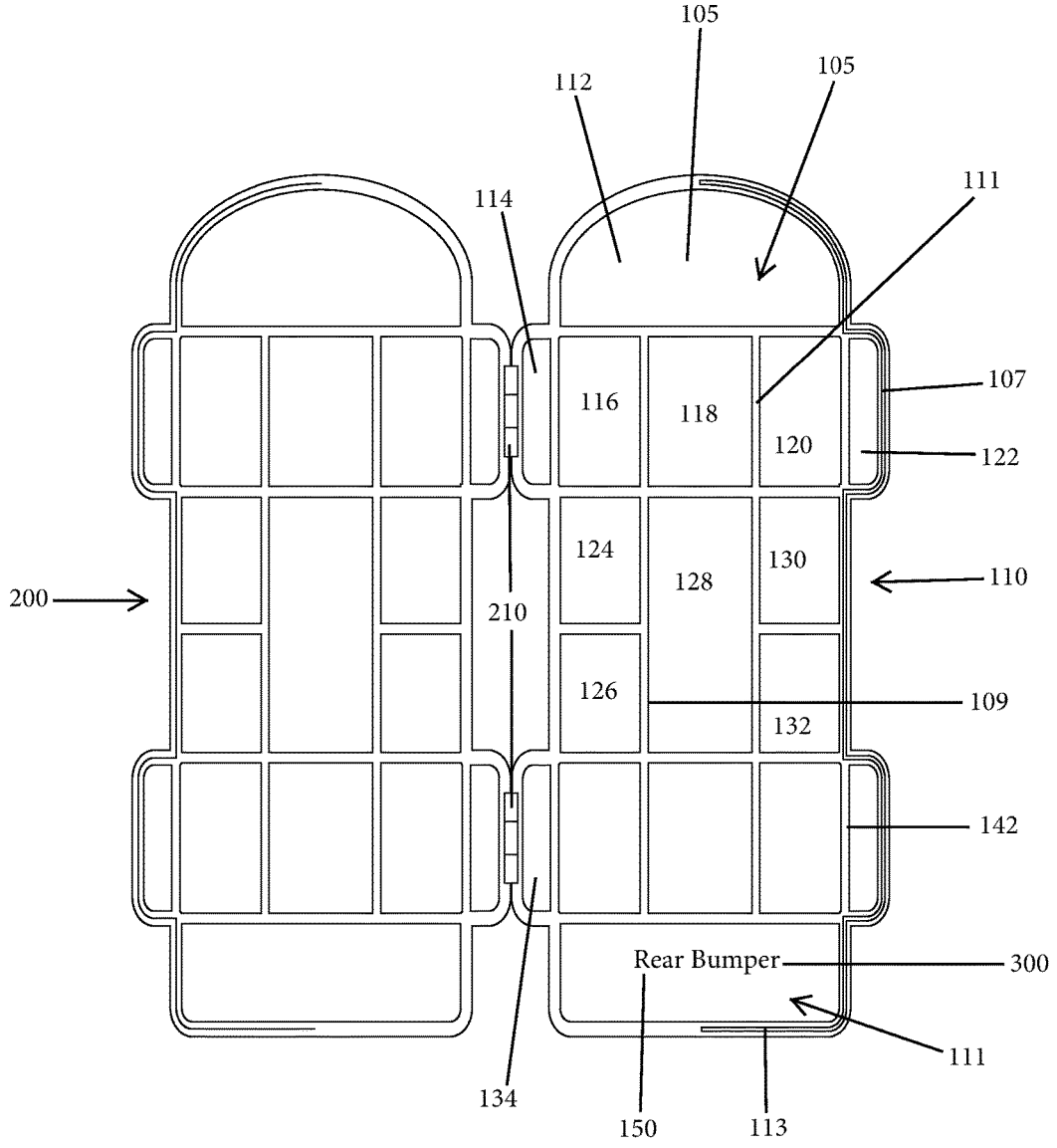
FIG. 2 is a top plan view of the car-shaped hardware tray of FIG. 1.

FIG. 1 illustrates a car-shaped hardware tray 100 that has a base 110 and a cover 200. The base 110 is a three-dimensional object and includes a floor 105 and a plurality of upstanding walls including an outer peripheral wall 107 and a plurality of internal walls 109. The upstanding walls 107, 109 defined not only the overall shape of the base 110 but also define a plurality of compartments 111.

In accordance with the present invention, the hardware tray 100 is in the shape of a car (vehicle) and the plurality of compartments 111 are positioned in the tray so that they simulate and correspond to certain parts of the car and can be and preferably are labeled as such to assist the user in identifying each of the compartments 111.

For example, the compartments 111 include, but are not limited to the following: a front bumper compartment 112, driver front wheel 114, front left fender 116, hood 118, front right fender 120, passenger front wheel 122, left front door 124, left rear door 126, roof flooring 128, right front door 130, right rear door 132, driver rear wheel 134, rear left quarter panel 136, trunk 138, rear right quarter panel 140, passenger rear wheel 142; and rear bumper 150.

In accordance with the present invention, the hardware tray 100 is shaped like a car and the individual compartments 111 are located in areas of the tray 100 that correspond to a specific part or area of the car. For example, one end of the tray 100 has a large rounded compartment 112 that extends across the entire width of the tray 100 and corresponds to the front bumper of the vehicle. Similarly, the other end of the tray 100 has a large compartment 150 that extends across the entire width of the tray 100 and corresponds to the rear bumper of the vehicle.

The other compartments 111 are located in areas of the tray 100 that accurately depict their locations relative to the vehicle. For example, the hardware associated with the wheels is placed in a corresponding wheel compartment that protrudes outwardly from the sides of the tray 100 so as to simulate a wheel well and tire.

Accordingly, the location of each compartment 111 within the tray 100 matches the location of an actual vehicle from which the hardware is taken. In this way, when a user removes hardware from a vehicle being repaired, the user places the hardware in the compartment 111 that corresponds to the part being repaired on the vehicle. For example, if the front bumper is removed in order to repair the front bumper or reach another part behind the front bumper, etc., the hardware that is removed from the front bumper, e.g., nuts, clips, bolts, and other small parts, etc., is placed in compartment 112 which corresponds to the front bumper compartment. In this way, the hardware taken off of the front bumper is carefully segregated from the other hardware associated with the other parts and thus, cannot be accidentally comingled or misplaced. By shaping the tray 100 in a vehicle shape, the user immediately knows where to place and where to retrieve hardware when working on any vehicle.

It will also be appreciated that each compartment 111 can have identification indicia 300 that labels each compartment so that the user knows what parts are to be received in each compartment 111. For example, the floor of each compartment can have a label that identifies the specific compartment by name. For example, compartment 112 is identified by a label with the text "Front Bumper". The labels for the other compartments 111 are identified with the names identified above.

It will be appreciated that the tray 100 can have more or less compartments 111 than indicated in the drawings and discussed herein.

The cover 200 is the mirror image of the base 110 and closes off the base 110 when in the close position. The cover 200 is attached to the base 110 using any number of conventional techniques, including but not limited to the use of hinges 210 (as shown in FIG. 1) or the like.

Figure 3:
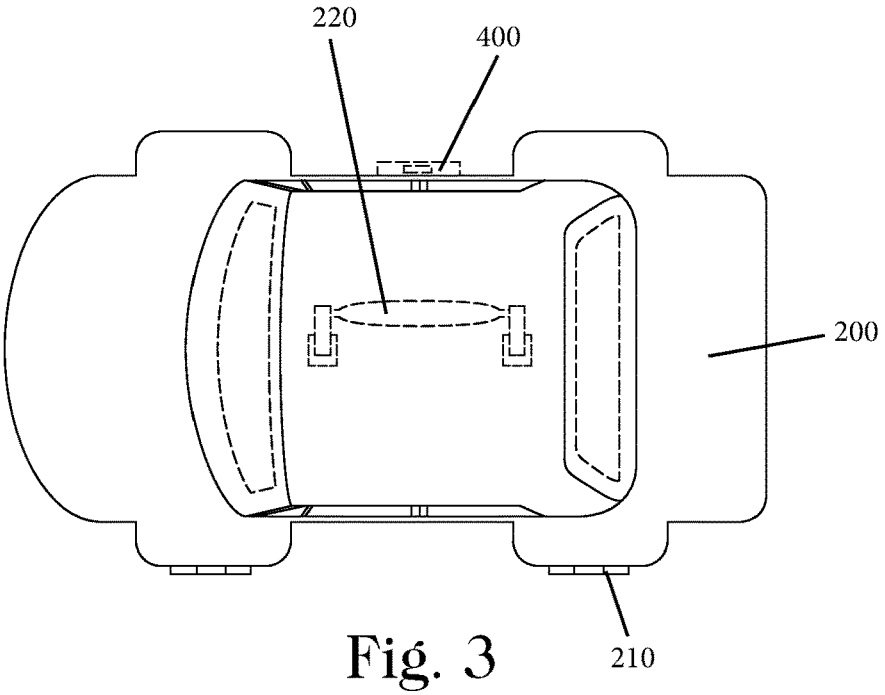
FIG. 3 is a top plan view of the car-shaped hardware tray in a closed position.
Figure 4:
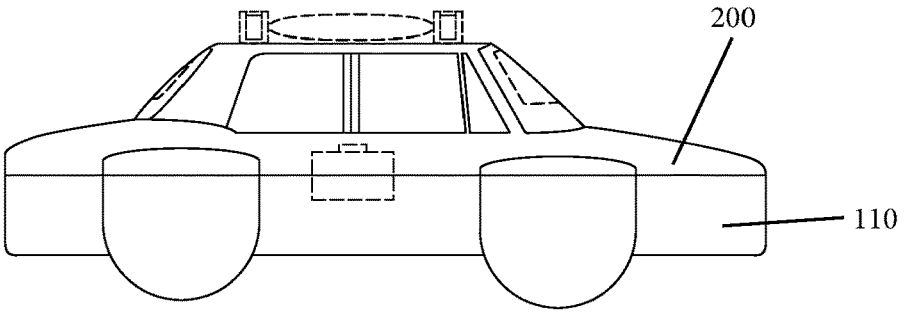
FIG. 4 is a right side elevation view of the car-shaped hardware tray.
Figure 5:
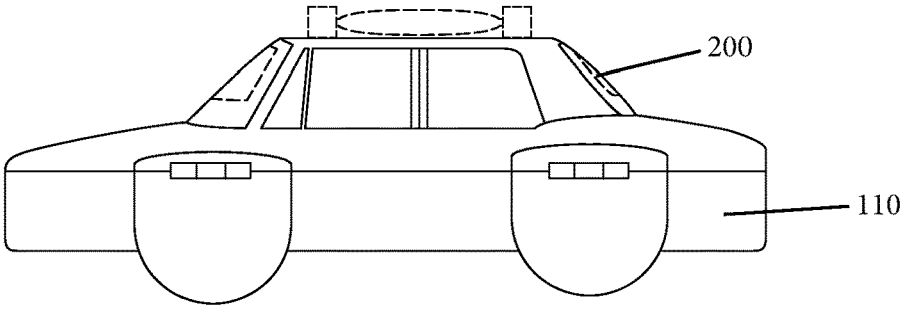
FIG. 5 is a left side elevation view of the car-shaped hardware tray.

As shown in FIGS. 3-5, the cover 200 also resembles the top half of a vehicle and therefore, when the cover 200 and base 110 are closed, the tray 100 resembles a vehicle. A friction fit can be formed between the cover 200 and the base 110 in that at least a portion of the outer wall of the base 110 can include a groove 113 that is received within a corresponding raised lip 215 formed along the outer wall of the cover 200. When the cover 200 is closed on the base 110, the lip 215 is frictionally received within the groove 113 resulting in a friction fit between the two.

As shown in FIGS. 3-5, the cover 200 can include a handle 220 that extends across a top surface of the cover 200 to allow the user to easily grasp and pick up the tray 100. The handle 220 can pivot between a down position (storage) and an up position (in use position).

The tray 100 preferably includes a latch or lock 400 to make sure that the cover 200 and base 110 remain securely attached to one another. One part of the latch 400 is associated with the cover 200 and the other part of the latch 400 is associated with the base 110.

It will also be appreciated that additional accessories can be provided. For example, a light can be provided and incorporated into the underside of the cover and angled at such an angle that the emitted light shines on the base 110 to illuminate the contents contained within the base 110 in poor lighting environments.

Also partitioning members (not shown) can be provided for insertion into one of the compartments 111 for subdividing the compartment 111. The partitioning member can be in the form of a flexible plastic wall structure that is sized to frictionally fit within one or more of the compartments 111 and therefore, to insert the partitioning member, the member is slightly flexed and then inserted into the interior of one of the compartments 111. This allows the user to subdivide the compartment 111 so that different fasteners or parts can be separated within the same compartment.

Each of the base 110 and cover 200 can be formed of any number of different materials, including plastics and metals, and in one exemplary embodiment, each of the base 110 and cover 200 is formed of a molded plastic.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed:

1. A car-shaped hardware tray comprising:

a hollow base in the shape of a bottom portion of a car in that the hollow base includes a first front bumper portion, a first rear bumper portion, a set of four bottom tire portions, and a first main body portion; and a cover that is pivotally attached to the hollow base, the cover having a shape in a form of a top portion of the car and the shape of the cover is complementary to the shape of the hollow base and includes a second front bumper portion, a second rear bumper portion, a set of four upper tire portions, and a second main body portion;

wherein the hollow base further includes a plurality of upstanding walls that define a plurality of individual separated interior compartments for receiving hardware and an underside of the cover includes a plurality of ribs that complement and seat against the plurality of upstanding walls when the cover is in a closed position;

wherein each of the bottom tire portions extends outwardly from the first main body portion and comprises a receptacle that has a hollow interior storage area that comprises one of the plurality of interior compartments and is defined by sides and a floor and each of the upper tire portions extends outwardly from the second main body portion;

wherein each of the plurality of interior compartments is positioned in the hollow base so that the plurality of interior compartments correspond to different parts of the car and is for placement of hardware that is taken from the corresponding matching part of the car.

2. The car-shaped hardware tray of claim 1, wherein the first front bumper portion extends across an entire first end of the hollow base; the first rear bumper portion extends across an entire second end of the hollow base; the second front bumper portion extends across an entire first end of the cover and the second rear bumper portion extends across an entire second end of the cover, wherein the first front bumper portion has a hollow interior storage space that comprises one of the plurality of interior compartments and the second front bumper portion has a hollow interior storage space that comprises one of the plurality of the interior compartments, wherein the first front bumper portion and the first rear bumper portion have greater interior storage areas than the other interior compartments.

3. The car-shaped hardware tray of claim 1, wherein the hollow base includes a first set of interior compartments between two of the bottom tire portions that represent rear tires and the hollow base includes a second set of interior compartments between two of the bottom tire portions that represent front tires.

4. The car-shaped hardware tray of claim 3, wherein the first set of interior compartments are labeled as a rear left quarter panel, a trunk, and a rear right quarter panel and are configured for receiving hardware from a rear left quarter panel, a trunk, and a rear right quarter panel, respectively, of a car, wherein a first common wall is shared between the rear left quarter panel and one bottom tire portion and a second common wall is shared between the rear right quarter panel and another bottom tire portion.

5. The car-shaped hardware tray of claim 3, wherein the second set of interior compartments are labeled as a front left quarter panel, a hood, and a front right quarter panel and are configured for receiving hardware from a front left quarter panel, a hood, and a front right quarter panel, respectively, of a car.

6. The car-shaped hardware tray of claim 3, wherein the hollow base includes a third set of interior compartments located between the first and second sets of interior compartments, the third set of interior compartments being labeled as a left front door, a left rear door, roof flooring, a right front door, a right rear door and being configured for receiving hardware from a left front door, a left rear door, roof flooring, a right front door, a right rear door, respectively, of a car.

7. The car-shaped hardware tray of claim 1, wherein a first hinge is disposed between one bottom tire portion on a first side of the hollow base and the corresponding one upper tire portion along a first side of the cover and a second hinge is disposed between the other bottom tire portion on the first side of the hollow base and the corresponding other upper tire portion along the first side of the cover.

8. The car-shaped hardware tray of claim 1, wherein an outer peripheral wall of the hollow base includes a groove that receives a peripheral edge of the cover.

9. The car-shaped hardware tray of claim 1, wherein an upper surface of the cover includes a pivotable handle.

10. The car-shaped hardware tray of claim 1, wherein each interior compartment includes a label disposed therein that identifies the interior compartment by name.

11. The car-shaped hardware tray of claim 1, wherein the plurality of interior compartments includes three of more different sized interior compartments.

12. A method for holding hardware removed from a car comprising the steps of:

providing the car-shaped hardware tray of claim 1;

opening the car-shaped hardware tray;

removing the hardware from a first location on the car and inserting the removed hardware into one of the plurality of interior compartments that occupies a location in the car-shaped hardware tray that mirrors the first location on the car.

* * * * *